United States Patent [19]

Taylor et al.

[11] Patent Number: 4,487,539

[45] Date of Patent: Dec. 11, 1984

[54] METHOD AND APPARATUS FOR THE SCORING AND PARTING OF CAN BODIES

[75] Inventors: Frederick G. Taylor, Camano Island, Wash.; Lawrence Casqueiro, Salem, Oreg.

[73] Assignee: American Can Company, Greenwich, Conn.

[21] Appl. No.: 460,533

[22] Filed: Jan. 24, 1983

[51] Int. Cl.[3] ..... B26D 3/00

[52] U.S. Cl. ..... 413/55; 83/51; 83/864; 225/3; 225/99

[58] Field of Search ..... 413/55; 225/103, 99, 225/3; 72/366; 83/51, 863, 864

[56] References Cited

FOREIGN PATENT DOCUMENTS 2065009 6/1981 United Kingdom ..... 413/55

*Primary Examiner*—W. D. Bray

*Attorney, Agent, or Firm*—Paul R. Audet; Douglas W. Wyatt

[57] ABSTRACT

In the production of metal cans, a sheet metal body plate (blank) is scored with aligned upper and lower score lines and then formed into a cylindrical single can body. Preferably the scoring is in steps; first, scoring the upper score line using a scoring roller and an anvil wheel; and, secondly, scoring the lower score line using a second scoring roller and a second anvil wheel. Then the single can bodies are conveyed by a conveyor belt and rolled over the knife edge (parting edge) of an elongated parting rail, with the parting edge aligned with the score line and with the conveyor applying pressure on each can body to part each one on the parting edge, thereby forming two can bodies from the single can body.

7 Claims, 7 Drawing Figures

METHOD AND APPARATUS FOR THE SCORING AND PARTING OF CAN BODIES

BACKGROUND OF THE INVENTION

The present invention relates to a method and apparatus in the production of metal can bodies.

The production of metal cans is a highly developed industrial field, with millions of metal cans being produced each day. The formation of the cylindrical part of a can, called the "can body", must be at a high rate of production and without waste of material, in order to be economical.

The prior issued patents have suggested that one method of producing can bodies is to form score lines crosswise on an elongated metal body plate. The plate is then joined along two sides to form an elongated tube. The score lines are completely around the circumference of the formed tube. In effect, each score line is a ring perpendicular to the imaginary axis of the tube. The tube portion between two adjacent score lines forms a can body. The tube is then conveyed between a set of rollers which turns the end can body at an angle to the axis of the elongated tube, causing the can bodies to part (separate) along each score line. That method, using a series of opposed rollers at different angles to an axis, is shown in U.S. Pat. No. 3,068,344 entitled "Combination Electrical and Mechanical Can Separating Means On Continuous Welding Machines" and U.S. Pat. No. 2,444,463 entitled "Method of Producing Can Bodies". In U.S. Pat. No. 3,257,055 entitled "Oscillating Breakoff Mechanism For Separating Scored Can Bodies", the can bodies along the elongated tube are separated by sets of rollers which oscillate relative to the imaginary axis of the tube.

The use of aligned score lines on opposite sides of a metal blank, which is then broken along the score line, is known from U.S. Pat. No. 3,821,911 entitled "Apparatus For Forming Opposed Score Lines Between Rows of Characters On One Or Both Sides Of A Thin Metal Plate". The score lines are formed by opposed circular blades and the blank is used to form a scored metal sheet, having letters or numerals, which may be broken off from the sheet. Similarly, in U.S. Pat. No. 2,053,375 entitled "Bar Making Process", opposed score-forming rollers form aligned upper and lower score lines in a metal bar which, in a subsequent step, is broken along the score line.

OBJECTIVES AND FEATURES OF THE INVENTION

It is an objective of the present invention to provide a method and apparatus for producing two can bodies, preferably of equal height, from a single cylindrical tubular can body by parting the single can body along a pre-formed circumferential score line.

It is a further objective of the present invention to provide such a method and apparatus which will be relatively uncomplicated in its process steps and its machine elements to thereby avoid production interruptions, which may occur with complex machinery, and permit high-speed production.

It is a further objective of the present invention to provide such a method and apparatus which utilizes an improved type of score line, and the machinery to produce it; which improved score line reduces the likelihood of edge cracking, improves the ability to form an even and smooth edge of he body (plate), reduces edge burr at the parted score line, and reduces wear on the tools forming the score line.

It is a further objective of the present invention to provide such a method and apparatus in which the two can bodies are produced without distortion in shape along their common score line, with a relatively improved edge formed by the score line and with a controlled burr that is in line with the plate wall.

It is a further objective of the present invention to provide such a method and apparatus in which the edge, along the score line, is sufficiently formed to avoid an additional pre-flanging step and in which the parting will not damage the enamel covering of the can body near the score line.

It is a feature of the present invention to provide a method in the production of metal cans. The method includes the step of forming a score line on a sheet metal body plate (metal blank). The next step is to form the sheet metal body plate into a single can body having a cylindrical tubular form, with the score line being a circumferential score line on the can body, preferably midway between the ends. The single can body is conveyed to an elongated parting rail having a parting edge positioned on the opposite side of the can body, by using a flexible conveyor belt on one side of the can body. Sufficient force is then applied by the belt against the can body to separate it into two can bodies on the rail edge.

It is a further feature of the present invention to provide an improved set of aligned score lines on the body plate which are formed in sequence, first forming an upper score line and secondly forming a lower score line.

BRIEF DESCRIPTION OF THE DRAWINGS

Other objectives and features of the invention will be apparent from the following detailed description which should be taken in conjunction with the accompanying drawings.

In the drawings.

DETAILED DESCRIPTION OF THE INVENTION

A single can body for use in the manufacture of cans is formed from a sheet metal body plate (blank). The metal body plate is scored with aligned upper and lower score lines in a series of operational steps. The score lines are formed by rotatable rolls (wheels) which are rotatable about an axis. The body plate is conveyed relative to the rapidly revolving rolls, causing the edge of the rolls to form a score line (elongated depression) in the body plate.

The body plate is then formed into a cylinder by joining its two free sides, the cylinder being round in cross-section and forming a single can body. The joining of the sides may be done by overlapping and welding with a wire between the overlapped sides. Preferably the score line is midway between the open ends of the single can body and, in effect, is a circumferential ring perpendicular to the imaginary axis through the single can body.

Figure 1:
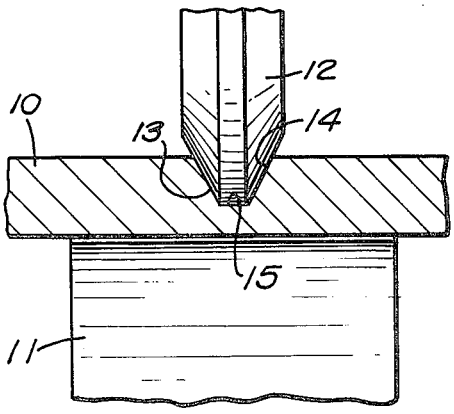
FIG. 1 is a front cross-sectional view showing the formation of the upper score line in the body plate (sheet metal blank)

As shown in FIG. 1, in the first operation the body plate 10 is conveyed between a bottom anvil roll 11 and an upper scoring roll 12. The edge 13 of the rotating scoring roll 12 forms a V-shaped score line (elongated depression) 14 having a flat bottom 15.

Figure 2:
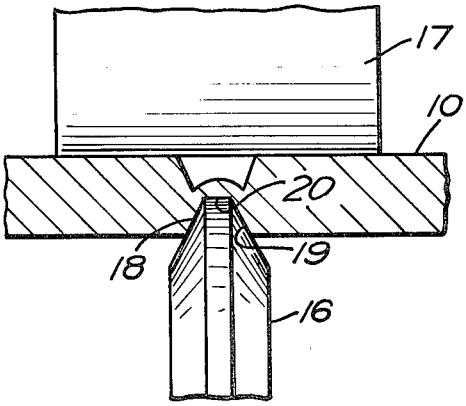
FIG. 2 is a front cross-sectional view showing the formation of the lower score line.

In the second operational step, illustrated in FIG. 2, the body plate 10 is conveyed between a lower scoring roll 16 and an upper anvil roll 17. The edge 18 of the lower scoring roll 16 preferably is of the same size and shape as the edge 13 of the upper scoring roll 12 (see FIG. 1). The edge 18 forms an inverted V-shaped score line 19 having a flat top 20. The score line 19 is directly aligned with the upper score line 14 shown in FIG. 1.

Preferably the anvil rolls 11 and 17 are each a cylindrical roll which is round in cross-section and of a constant diameter so that the anvil roll, which is in contact with the body plate, supports the body plate and prevents it from bulging.

Figure 3:
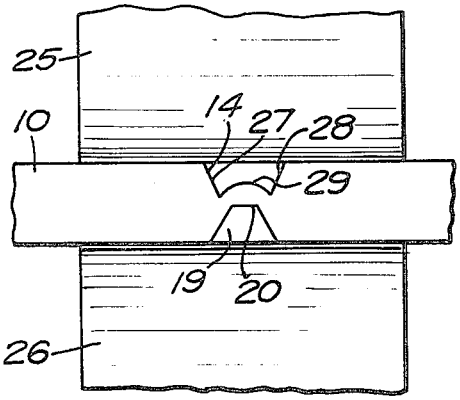
FIG. 3 is a front plan view showing the flattening of the body plate at the score lines.

The third operational step is an optional step and may be omitted. As illustrated in FIG. 3, the body plate 10 is flattened between a rotating upper flattening roll 25 and a lower flattening roll 26. The lower flattening roll 26 is preferably rotated at the same speed as the upper flattening roll 25 and in an opposite sense of direction so as to convey the body plate 10 between the two rolls 25 and 26.

Figure 4:
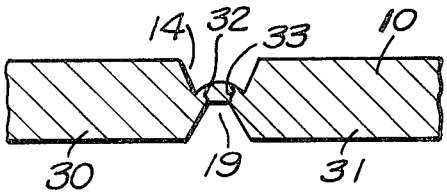
FIG. 4 is a front cross-sectional view showing the fracture of the body plate at the score line.

The preferred form of the two aligned score lines is also illustrated in cross-section in FIG. 3. As shown, the bottom score line 19 is an inverted V-shape having a flat top 20. Due to the force of the lower scoring roll 16 (FIG. 2), in the second operational step the cross-sectional shape of the upper score line 14 has changed. It now has inwardly directed sides 27 and 28 and a bowed bottom 29. When the body plate 10, having the opposed score lines 14 and 19, is subjected to a force perpendicular to the plane of the body plate, the body plate will be separated into two portions 30 and 31 along the fracture lines, either by the left fracture line 32 or the right fracture line 33, as shown in FIG. 4.

Preferably the scoring rolls 12, 16, the anvil rolls 11, 17, and the flattening rolls 25, 26, are driven by wheels which may be mounted in tandem as portions of a single machine. The machine which drives the various scoring rolls, anvil rolls and flattening rolls is not shown in greater detail since scoring machines are well-known in the industry, although generally such machines are used to form only a single score line in a body plate.

Figure 5:
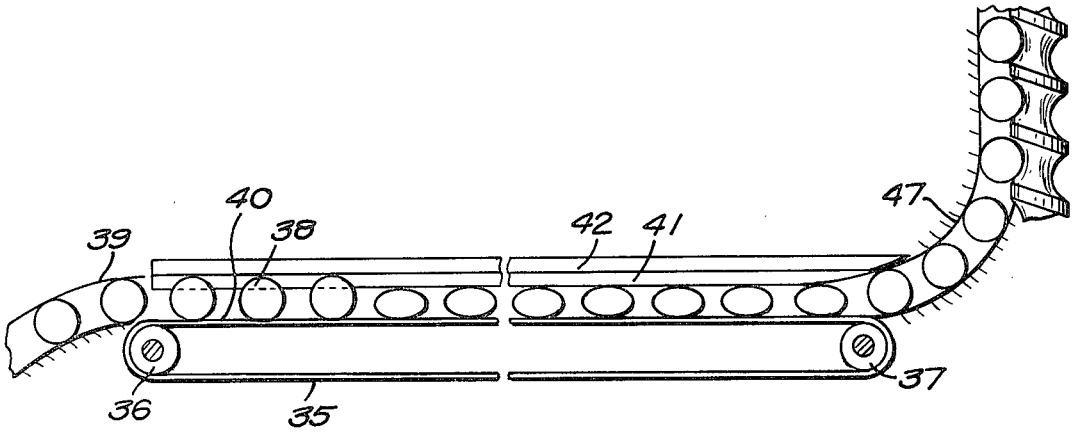
FIG. 5 is a side plan view illustrating the machine utilized for separating the single can body along the score line.
Figure 6:
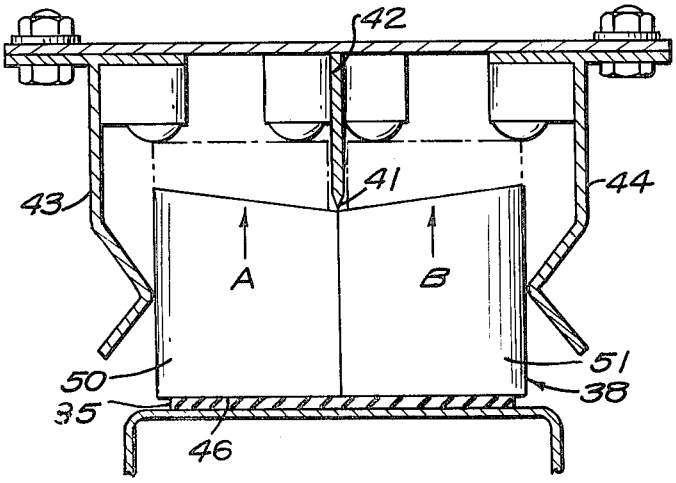
FIG. 6 is an enlarged front cross-sectional view of a portion of the machine of FIG. 5.

The apparatus which is preferably used to part the single can body into two can bodies along the score lines 14, 19 is illustrated in FIG. 5. As shown therein, a flexible conveyor belt 35 is an elongated closed belt which is driven by the respective drive rollers 36, 37. The single can bodies 38 exit in tandem from the orifice of the chute 39 to the top 40 of the conveyor belt 35. The can bodies are conveyed by the conveyor belt 35 to beneath a parting edge 41, preferably a knife edge, of an elongated linear parting rail 42. Preferably the can bodies are rolled (rotated) by the conveyor belt along the parting edge. The rail 42, as shown in FIG. 6, is positioned preferably midway between the can body guides 43 and 44. Such midway position would only be used if the score line is midway between the ends of the single can body 38. In any event, the position of the parting edge corresponds to that of the score lines on the single can bodies.

The conveyor belt 35 is positioned so as to roll the can bodies along the parting edge and exert a sufficient force on the side 46 of the can body 38 which is in contact with the conveyor belt 35 to part the can body along the score line. Such foce causes the can body 38, which is somewhat flexible, to be raised on both sides of the edge 41, as shown by the arrows A and B in FIG. 6. It will be understood, however, that, although the orientation of the apparatus in FIG. 5 is such as to force the cans upwardly, the orientation may be changed so that the parting edge is positioned beneath the cans and the conveyor belt positioned above the cans. After the parting edge has separated the can bodies, they are conveyed by the conveyor belt to the exit chute 47.

Figure 7:
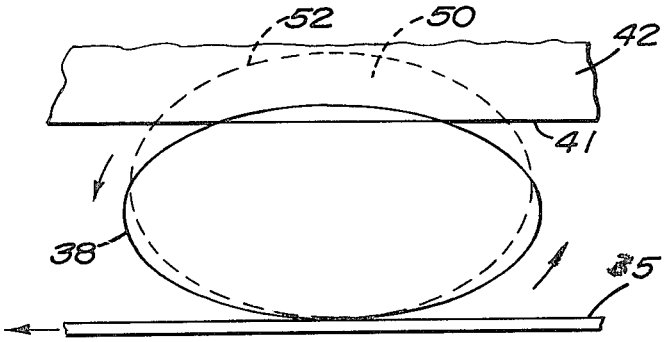
FIG. 7 is an enlarged side view illustrating the movement of the single can body in relationship to the parting edge.

As seen in FIGS. 6 and 7, the can body 38 is squeezed between the conveyor belt 35 and the parting edge 41. The can will break along the over/under score lines, permitting the parted can body 50 and 51 to obtain their normal shape, which is round in cross-section, as illustrated by dash lines 52.

In one preferred embodiment of the present invention, to effect a better rolling action of the can bodies on the parting edge, the conveyor belt is driven with a varying speed, such as the repeated series fast, slow, fast, slow, etc., instead of a constant speed. Although the present invention has been described in connection with an upper and lower score line, the parting system and method may be used even when only a single score line is employed.

What is claimed is:

1. A method in the producing of metal cans including the steps of:

forming a score line on a sheet metal body plate;

forming said sheet metal blank into a single can body of cylindrical tubular from with said score line being a circumferential score line on the can body;

conveying the single can body using a flexible conveyor belt on one side of the can body to an elongated parting rail having a parting edge positioned on the opposite side of the can body and rolling the can body along the parting edge while applying sufficient force, created by the belt acting against the can body, to separate it into two can bodies on the rail edge.

2. A method of claim 1 wherein the score line is midway between the ends of the single can body to thereby produce two can bodies of equal height from said single can body.

3. A method of claim 1 wherein the score line is made by first forming an upper score line on one face of the sheet metal plate, forming a lower score line directly opposite said upper score line on the opposite face of the sheet metal blank.

4. A method in the production of metal cans, including the steps of:

forming an upper and a lower score line on a sheet metal body plate, the said score lines being aligned;

forming said sheet metal body plate into a single can body having a cylindrical tubular form, with said score lines forming a circumferential score line on the inside and an aligned circumferential score line on the outside of the can body;

conveying the single can body using a flexible conveyor belt on one side of the can body to an elongated parting rail having a parting edge positioned on the opposite side of the can body and rolling the can body along the parting edge with sufficient foce, created by the belt acting against the can body, to separate it into two can bodies on the rail edge.

5. An apparatus to form two can bodies from a single can body, which single can body is a cylindrical tubular sheet metal member having a circumferential score line between its ends, the apparatus including:

an elongated conveyor belt means, having a direction of travel and comprising a flexible conveyor belt, to convey the single can body and apply a selected pressure to one side thereof;

a linear elongated parting rail means having a parting edge, positioned with its length in the direction of travel of said conveyor belt, and opposite said conveyor belt, and positioned at a distance from said conveyor belt slightly less than the outside diameter of said can body, and with said parting edge directly in line with said score line;

the conveyor belt means rolling said single can body along said parting edge to separate said single can body into two can bodies along said score line.

6. An apparatus to form two can bodies as in claim 5 wherein said parting edge is positioned midway between the ends of the single can body to part it along its midway score line.

7. An apparatus to from two can bodies as in claim 5 and further including, as the apparatus to form said score line in tandem, an upper scoring roll means, and opposed thereto a cylindrical round anvil roll to form an upper score line thereon; a lower scoring roller means and opposed thereto a cylindrical round cross-sectional anvil roll which lower scoring roll forms a lower score line on the opposite face of said blank from said upper score line and aligned therewith.

* * * * *